US007341108B2

(12) United States Patent
Naizer et al.

(10) Patent No.: US 7,341,108 B2
(45) Date of Patent: Mar. 11, 2008

(54) WELL DOWNHOLE LIQUID DISPENSER

(76) Inventors: David Anthony Naizer, 2802 Avenue U, Snyder, TX (US) 79549; Dennis Foy Westmoreland, 2881 Tabosa Dr., Snyder, TX (US) 79549

( * ) Notice: Subject to any disclaimer, the term of this patent is extended or adjusted under 35 U.S.C. 154(b) by 0 days.

(21) Appl. No.: 10/724,409

(22) Filed: Nov. 26, 2003

(65) Prior Publication Data

US 2005/0109500 A1 May 26, 2005

(51) Int. Cl.
*E21B 34/06* (2006.01)
*F01L 3/10* (2006.01)
*F16K 15/00* (2006.01)

(52) U.S. Cl. ..... 166/374; 166/321; 166/325; 251/337; 137/535

(58) Field of Classification Search ..... 166/266, 166/269, 374, 316, 319, 321, 325, 332.1; 137/535–540, 543.23; 251/154, 336, 337, 251/354, 903

See application file for complete search history.

(56) References Cited

U.S. PATENT DOCUMENTS 2,339,487 A * 1/1944 King ..... 417/86
2,342,301 A * 2/1944 Peters ..... 137/155
2,465,060 A * 3/1949 Carlisle et al. ..... 417/112
2,556,867 A * 6/1951 Carlisle et al. ..... 137/155
2,634,689 A * 4/1953 Walton ..... 417/112
3,436,273 A * 4/1969 Gratzmuller ..... 429/54
3,601,191 A * 8/1971 McMurry et al. ..... 166/319
3,993,129 A * 11/1976 Watkins ..... 166/319
4,817,739 A * 4/1989 Jeter ..... 175/38
5,095,939 A * 3/1992 Alderfer et al. ..... 137/512.1
6,796,741 B1 * 9/2004 DeVaull et al. ..... 405/128.5

* cited by examiner

*Primary Examiner*—Kenneth Thompson
(74) *Attorney, Agent, or Firm*—Aaron R. Clements; Hurley & Guinn

(57) ABSTRACT

A well downhole liquid dispenser is disclosed in which an inlet/discharge port assembly is provided having an inlet port in fluid communication with the shoulders of a conical piston. The point of the conical piston is in physical contact with the discharge channel leading from the center of the inlet/discharge port assembly to the discharge ports on the exterior of the inlet/discharge port assembly. The piston is held in place by an adjustable tensioning mechanism by which the pressure required to depress the piston may be varied to match the hydrostatic column pressure of a liquid column connected to the inlet port of the dispenser such that when the hydrostatic column pressure reaches a desired level, the piston is depressed, allowing fluid to flow from the liquid column regardless of the exterior downhole pressure exerted on the point of the piston through the discharge ports.

8 Claims, 4 Drawing Sheets

WELL DOWNHOLE LIQUID DISPENSER

CROSS REFERENCE TO RELATED APPLICATIONS

Reference is hereby made to and priority is claimed from a provisional application, filed Nov. 26, 2002.

STATEMENT REGARDING FEDERALLY SPONSORED RESEARCH

Not Applicable.

REFERENCE TO "MICROFICHE APPENDIX"

Not Applicable.

BACKGROUND OF THE INVENTION

This Invention relates to a device for dispensing or injecting a controlled amount of desired liquid chemical into a well. Wells, and particularly oil wells, rely upon the downhole injection of chemicals, including surfactants, corrosion inhibitors, foaming chemicals, and the like to enhance well production.

Existing methods of injecting chemicals into wells include direct injection through the use of a simple check valve placed in a tubing string inserted into the well, with the operation of the valve depending on a balance of the downhole pressure, hydrostatic column pressure of the chemical in the tubing string, and additional injection pressure exerted on the inserted chemical. Due to the enormous pressures at typical oil well depths, these valves are inadequate to survive the environment and are frequently subject to back flow of downhole chemicals, gases, and fluids. Many of these chemicals are highly corrosive and are damaging to equipment once a back flow occurs. Furthermore, with these existing systems, chemicals must be inserted through the tubing at a hydrostatic pressure higher than the downhole pressure; most existing equipment is not designed to withstand the stresses involved. Furthermore, because the downhole pressure can vary widely, the hydrostatic column pressure can sometimes exceed the downhole pressure, allowing chemical to flow freely until the differential between the downhole pressure and the hydrostatic column pressure is sufficient to stem the free flow of chemical into the well. This free flow of chemical, combined with the regular inconsistent chemical injection associated with traditional check valves, leads to substantial waste of chemicals injected into the well. This wasted chemical is often expensive; furthermore, in some cases, an excess of injected chemical can be more harmful than helpful. A need exists, therefore, for an apparatus capable of delivering a steady, measured quantity of liquid chemical into a well without regard to the downhole pressure or the hydrostatic column pressure of chemical in the downhole tubing string.

SUMMARY OF THE INVENTION

The present Invention solves the problems described above by providing a chemical injection valve with an adjustable opening pressure which operates regularly regardless of the downhole operating pressure. In the instant invention, a tubular housing is provided in which a piston travels. The piston is sealed to the interior of the tubular housing my means of an O-ring which passes around the circumference of the tubing. The piston is kept under tension by a series of Bellville springs, the tension on which may be adjusted by a pressure adjustment screw located in the opposite end of the tubular housing from the piston. At the top end, the piston is conical in shape. The bottom end of the tubular housing is threaded to receive an end cap, and the top end of the tubular housing is threaded to receive the inlet/discharge port assembly.

The inlet/discharge port assembly consists of a solid machined body that includes a threaded inlet port at the top and a solid bottom portion. Two vertical inlet channels pass through the interior of the inlet port through the solid bottom portion such that the inlet port and the bottom of the port assembly are in communication with each other. Furthermore, a horizontal channel passes between the two vertical channels through the center of the port assembly, forming two openings in the side of the port assembly. These two openings are the discharge ports of the port assembly. A vertical discharge channel passes from the center of the bottom of the port assembly upwards until it intersects with the center of the horizontal channel which forms the discharge ports, thereby allowing fluid communication between the bottom of the port assembly and the discharge ports.

In another embodiment of the instant invention, the port assembly further includes a check valve and check valve seat plug which are positioned in the bottom of the inlet port, immediately above the bottom portion of the port assembly. This check valve acts as a further safety against back flow through the device.

When the port assembly is screwed into the top end of the tubular housing, it sits immediately above and in physical contact with the piston. Specifically, the tip of the conical end of the piston is in contact with the bottom of the vertical discharge channel such that in the ordinary rest position, the piston prevents fluid communication between the inlet channels and the discharge channel.

CATALOG OF ELEMENTS

Figure 1:
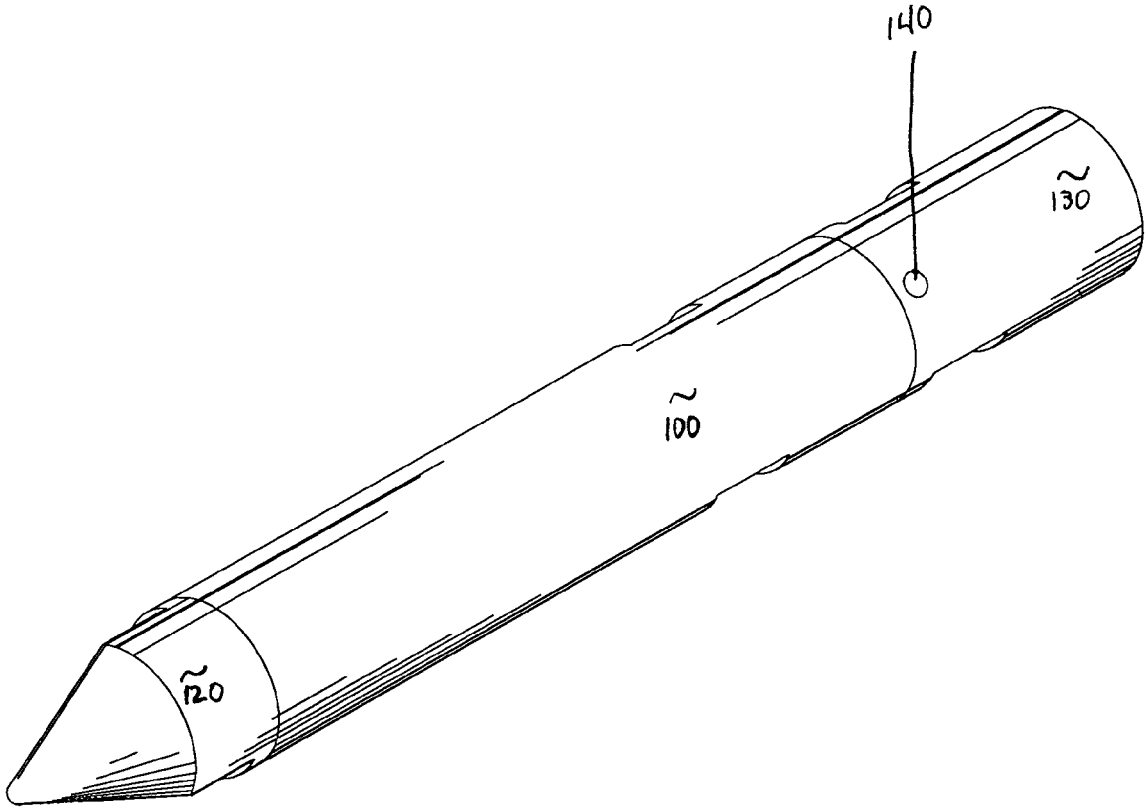
FIG. 1 is an oblique view of the device in its assembled form.

100 Spring housing
102 Piston retaining shoulder
110 Piston
112 Piston pressure springs
114 Pressure adjustment screw
116 Pressure adjustment lock screw
118 Piston O-ring
120 Bottom end cap
122 Bottom end cap O-ring
130 Input/discharge port assembly
132 Inlet port
134 Inlet channels
136 Vertical discharge channel
138 Horizontal discharge channel
140 Discharge ports
142 O-ring
150 Check valve
152 Check valve seat plug

DESCRIPTION

Figure 2:
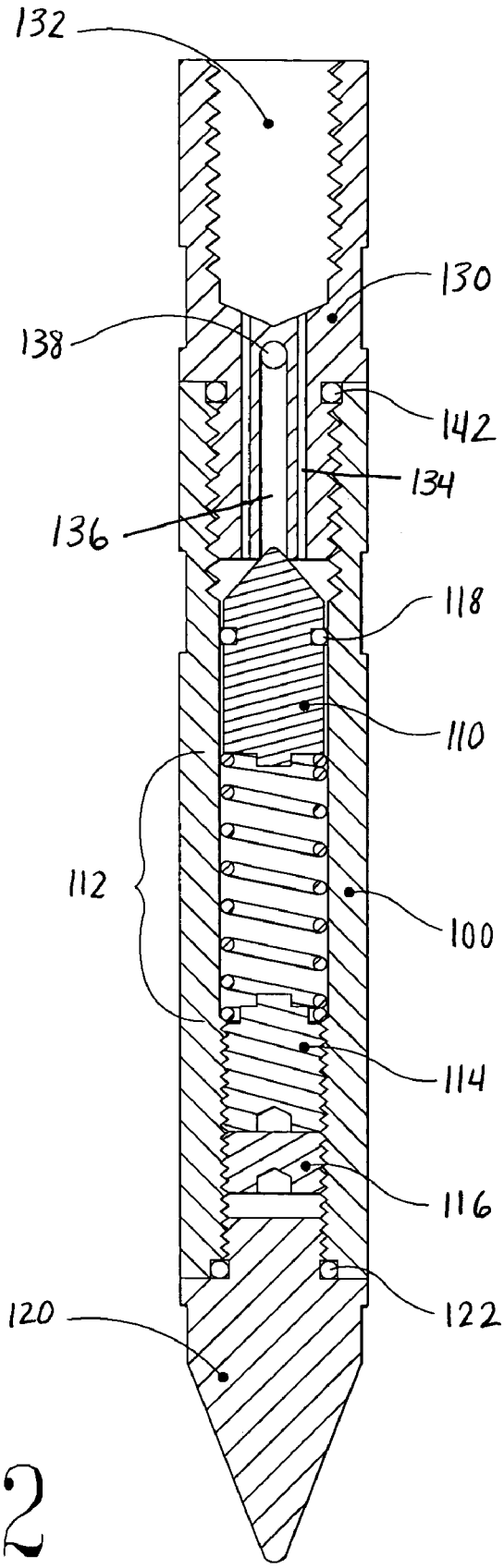
FIG. 2 is a cross-sectional view of the device and its internal parts
Figure 3:
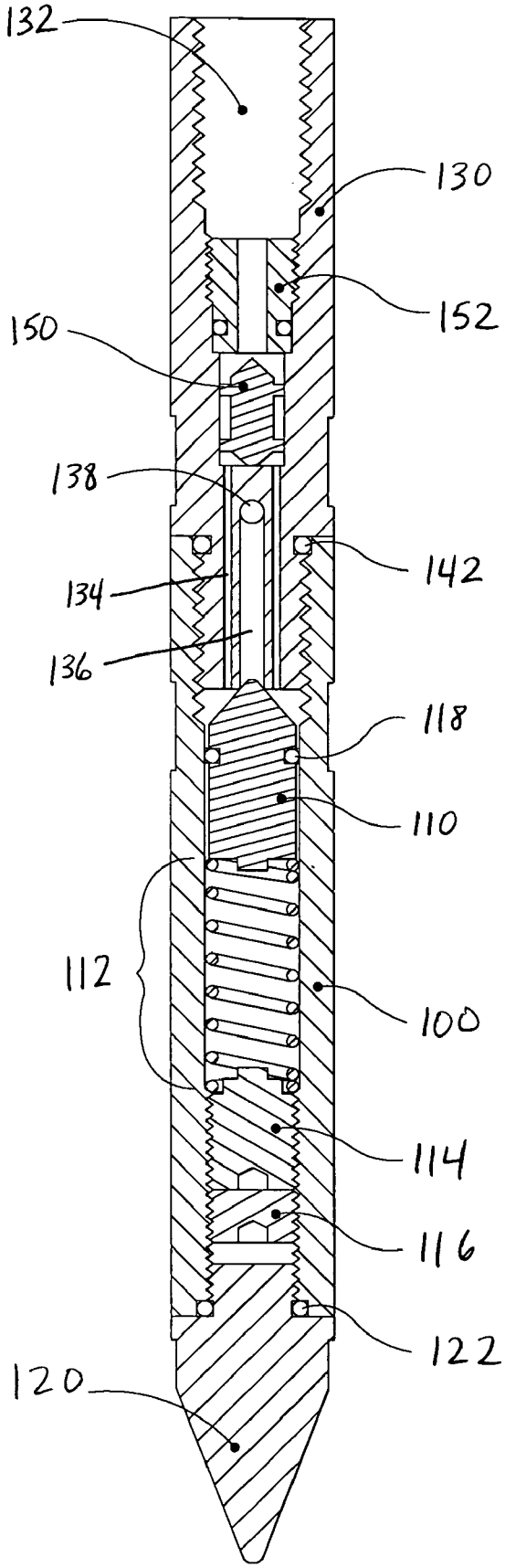
FIG. 3 is a cross-sectional view of the device and its internal parts with the optional check valve.
Figure 4:
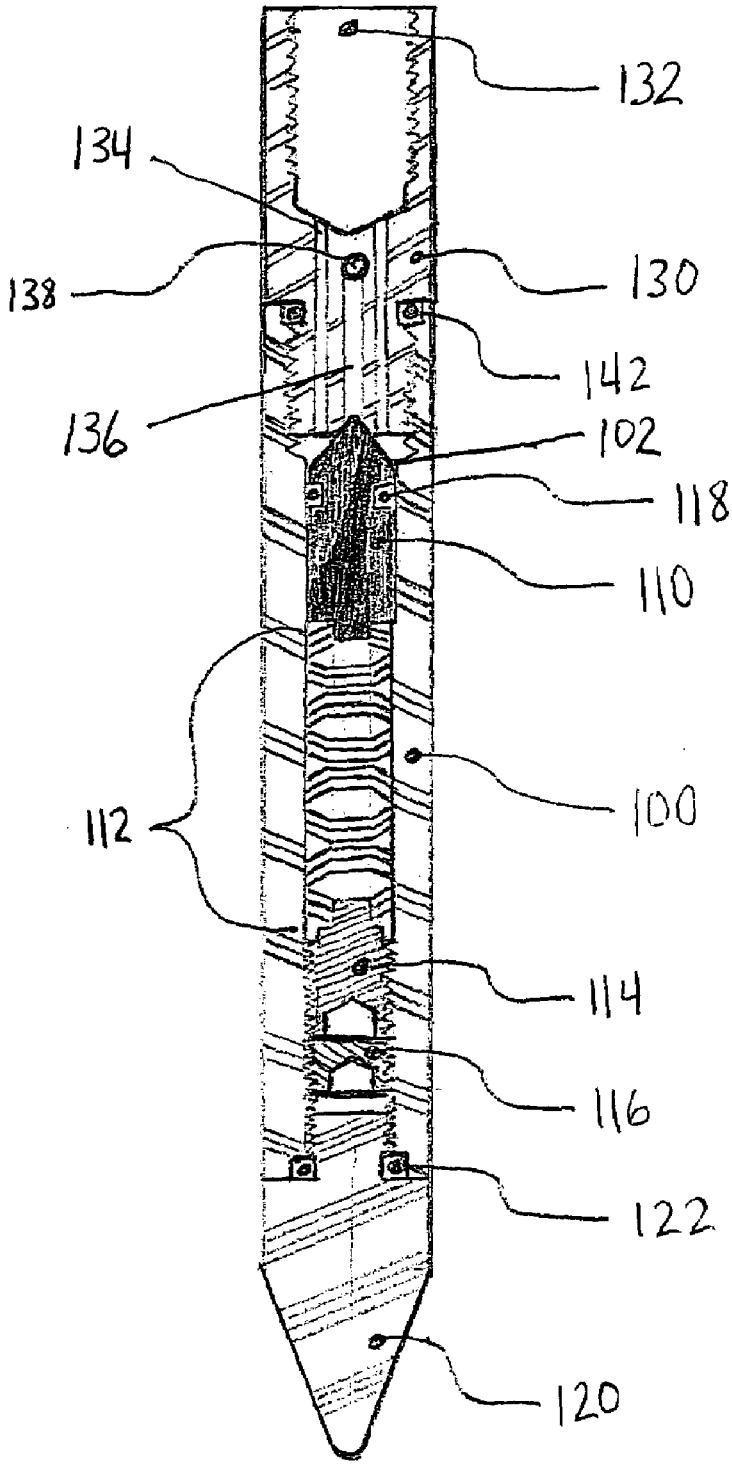
FIG. 4 is a cross-sectional view of the device and its internal parts showing the Bellville springs.

In this instant invention as shown in FIGS. 1-3, a tubular spring housing 100 is provided. The spring housing 100 is threaded at both its top and bottom ends and includes a central cavity in which a piston 110 actuates parallel to the axis of the spring housing 100. The piston 110 is a solid body with a conical upper end and is sealed to the interior of the spring housing 100 by means of a piston O-ring. The piston 110 is prevented from exiting the top end of the cavity within the spring housing 100 by a piston retaining shoulder 102 positioned at the top of the cavity. The bottom portion of the cavity is threaded in order for a pressure adjustment screw 114 and pressure adjustment lock screw 116 to be screwed into the bottom of the cavity. Those of ordinary skill in the art will understand the nature of the pressure adjustment screw 114 and pressure adjustment lock screw 116. Between the top of the pressure adjustment screw 116 and the bottom of the piston 110, a series of piston pressure springs 112 operate on both in order to keep the piston 110 pressed securely against the piston retaining shoulder 102. Those of ordinary skill in the art will understand that the piston pressure springs 112 may be of many types, but are preferably Bellville springs.

At the bottom of the spring housing 110, a bottom end cap 120 is screwed into the end of the cavity and is sealed to the spring housing 110 by means of an end cap O-ring 122. Above the cavity containing the piston 110, the interior of the spring housing 110 widens slightly and is threaded to accommodate an inlet/discharge port assembly 130.

The inlet/discharge port assembly 130 is made from a single piece. It is threaded around its lower portion in order to screw into the upper portion of the spring housing 110. Its upper portion includes a central cavity which forms the inlet port 132 of the device. The interior of the inlet port 132 is threaded to accommodate a standard tube string for installation of the device in a well application. Two vertical inlet channels 134 pass through the bottom of the inlet port 132 through the bottom of the inlet/discharge port assembly 130. Furthermore, a vertical discharge channel 136 passes from the center of the bottom of the inlet/discharge port assembly 130 until it bisects the horizontal discharge channel 138. The horizontal discharge channel 138 passes through the bottom portion of the inlet/discharge port assembly 130 between the two inlet channels 134. The ends of the horizontal discharge channel 138 form two discharge ports 140 which are located on either side of the bottom portion of the inlet/discharge port assembly 130. When screwed into the top of the spring housing 100, the inlet/discharge port assembly 130 is sealed to the spring housing 100 by means of an O-ring 142. Furthermore, when the inlet/discharge port assembly 130 is screwed into the top of the spring housing 100, the tip of the conical portion of the piston 110 is in physical contact with and seals the bottom of the vertical discharge channel 136. The piston 110 is kept in this position by the operation of the piston pressure springs 112.

In addition to the above described embodiment, the inlet/discharge port assembly 130 may additionally include a check valve 150 and check valve seat plug 152 located within the bottom portion of the inlet port 132, as shown in FIG. 3. Such a check valve 150 will be understood by those of ordinary skill in the art and consists essentially of a piston, cylindrical in shape but conical at both ends, with a diameter slightly smaller than the diameter of the interior of the inlet port 132. The check valve 150 is kept in vertical orientation within the inlet port 132 by a plurality of alignment tabs around the circumference of the check valve. Above the check valve 150, a check valve seat plug 152 is screwed into the inlet port and includes a central tubular channel of slightly smaller diameter than the diameter of the check valve 150. By this arrangement, the check valve 150 may slide vertically freely within the bottom of the inlet port 132, but is prevented from leaving the inlet port 132. Gravity will ordinarily keep the check valve 150 such that fluid may pass from the inlet port through the check valve seat plug 152 and then through the two inlet channels 134. It will be understood that should the direction of fluid flow reverse, however, the check plug 150 will be forced against the check valve seat plug 152, thereby stopping any back flow of fluid into the inlet port 130 and ultimately into the tubing string to which the device is attached.

In both embodiments of the instant invention, it will be understood that the various components of the device may be made from a number of materials, but it will be understood that stainless steel is the preferred material for fabricating the spring housing 100, bottom end cap 120, and inlet/discharge port assembly 130. Stainless steel has superior corrosion resistance compared to other alloys, and is therefore clearly preferred for environments encountered at the bottoms of wells. Furthermore, stainless steel has the strength required to withstand the tensions placed on the device by the various pressures involved. It will be further understood that the preferred material for fabrication of the piston 110 is a material softer than stainless steel, but with high corrosion resistance, such as polytetrafluoroethylene, commonly referred to as PTFE or by a variety of brand names.

In ordinary operation, the device comprising the invention is attached to the bottom of a tubing string which is inserted into a well. The tubing string is then filled with a fluid chemical. The fluid chemical flows through the tubing string into the inlet port 132 and thence through the inlet channels 134 into the top of the spring housing 100. The piston 110 and piston O-ring 118 prevent fluid flow into the cavity of the spring housing 100. It will be understood that when the piston 110 is in its ordinary position in contact with the bottom of the vertical discharge channel 136, exterior fluid and pressure operates on the piston through the discharge channels only on the small surface area of the tip of the piston 110. The hydrostatic column pressure of the fluid chemical, however, operates on the much larger surface of the shoulders of the conical portion of the piston 110. By this arrangement with the large disparity in surfaces upon which the interior hydrostatic column pressure and exterior downhole pressure may operate, it is virtually impossible for excessive exterior pressure to operate on the piston 110 in such a way as to allow back flow through the device. It will furthermore be readily seen that the piston 110 will only actuate when the hydrostatic column pressure operating on the shoulders of the top of the piston 110 is sufficient to overcome the force applied to the bottom of the piston 110 by the piston tensioning springs 112. By this arrangement, the piston pressure springs 112 may be set prior to installation of the device, with the setting of the piston pressure springs 112 being entirely dependent on the depth of the device and the hydrostatic column pressure of chemical above the device.

As such, this device overcomes the limitations of traditional check valves used to meter chemical into the bottom of wells. The unique arrangement of the inlet channels 134 in relation to the piston 110 and the discharge channel 138 allow for the device to operate independently of the exterior downhole pressure, allowing for a regular, measured amount of chemical to be dispensed through the device. Furthermore, should excessive downhole pressure build up, the small surface area of the piston 110 on which such pressure may operate ensures that little, if any, back flow may occur, particularly in the embodiment shown in FIG. 3, in which a traditional check valve serves as a backup to prevent back flow. In the event that downhole pressure drops unexpectedly, the device comprising the instant invention is not subject to the siphoning effect that can befall traditional check valves, in which an excessive amount of chemical may be dispensed; in the instant device, the hydrostatic column pressure is not balanced against the downhole pressure but is rather balanced against the force provided by the piston pressure springs 112.

Although the present invention has been described with reference to certain preferred versions thereof, other versions are possible. Therefore, the spirit and scope of the appended claims should not be limited to the description of the preferred versions contained herein. Additionally, the reader's attention is directed to all papers and documents which are filed concurrently with this specification and which are open to public inspection with this specification, and the contents of all such papers and documents are incorporated herein by reference. Any element in a claim that does not explicitly state "means for" performing a specified function, or "step for" performing a specific function, is not to be interpreted as a "means" or "step" clause as specified in 35 U.S.C. § 112(6).

The invention claimed is:

1. A well downhole liquid dispenser comprising an inlet port in fluid communication with the shoulders of a conically-shaped piston and one or more discharge ports in fluid communication with the point of said conically-shaped piston through a discharge channel, wherein the point of said conically-shaped piston is held in physical contact with and closes said discharge channel by tensioning means and wherein the circumference of the base of said conically-shaped piston is sealed, wherein said tensioning means may be adjusted to vary the pressure exerted by said tensioning means on said conically-shaped piston.

2. The well downhole liquid dispenser of claim 1, wherein said tensioning means comprise a spring, and wherein the tension on said spring may be adjusted by moving an adjustment screw.

3. A well downhole liqiuid dispenser comprising an inlet port in fluid communication with the shoulders of a conically-shaped piston and one or more discharge ports in fluid communication with the point of said conically-shaped piston through a discharge channel, wherein the point of said conically-shaped piston is held in physical contact with and closes said discharge channel by tensioning means, wherein said tensioning means may be adjusted to vary the pressure exerted by said tensioning means on said conically-shaped piston, wherein said well downhole liquid dispenser further comprises a check valve located within said inlet port, wherein said check valve allows fluid to flow from said inlet port through said discharge ports, but does not allow fluid to flow from said discharge ports through said inlet port.

4. The well downhole liquid dispenser of claim 3, wherein said tensioning means comprise a spring, and wherein the tension on said spring may be adjusted by moving an adjustment screw.

5. A well downhole liquid dispenser, comprising:

a. a tubular spring housing within which a piston having a conically-shaped end is placed, and wherein said piston is held in place at one end of said tubular spring housing by tensioning means also placed within said tubular spring housing, and wherein said tensioning means may be adjusted by adjustment means;

b. an inlet/discharge port assembly attached to said tubular spring housing at the end wherein said piston is located, wherein said inlet/discharge port further comprises:

i. an inlet port fluidly connected to the shoulders of the conical portion of said piston within said tubular spring housing by one or more vertical inlet channels which are positioned away from the center of said inlet/discharge port assembly;

ii. one or more discharge ports fluidly connected to the point of the conical portion of said piston within said tubular spring housing by a vertical discharge channel positioned at the, center of said inlet/discharge port and intersecting a horizontal discharge channel which fluidly connects said vertical discharge channel to said discharge ports;

c. wherein said point of said conical portion of said piston is held in physical contact with said vertical discharge channel by said tensioning means and wherein said piston may be actuated within said tubular spring housing.

6. The well downhole liquid dispenser of claim 5, wherein said tensioning means comprise a spring, and wherein said adjustment means comprise an adjustment screw, wherein said spring is placed between said piston and said adjustment screw.

7. The well downhole liquid dispenser of claim 5, wherein said inlet/discharge port assembly further comprises a check valve placed within said inlet port, wherein said check valve is held in said inlet port by a check valve seat plug.

8. The well downhole liquid dispenser of claim 6, wherein said inlet/discharge port assembly further comprises a check valve placed within said inlet port, wherein said check valve is held in said inlet port by a check valve seat plug.

* * * * *